US009736597B1

(12) United States Patent
Spiegelberg et al.

(10) Patent No.: US 9,736,597 B1
(45) Date of Patent: Aug. 15, 2017

(54) OPTICAL FIBER BASED MICROPHONE ARRAY FOR DETECTING ACOUSTIC EMISSIONS GENERATED BY AN AREA OF INTEREST

(71) Applicant: Siemens Energy, Inc., Orlando, FL (US)

(72) Inventors: Christine P. Spiegelberg, Winter Park, FL (US); Heiko Claussen, North Brunswick, NJ (US)

(73) Assignee: Siemens Energy, Inc., Orlando, FL (US)

( * ) Notice: Subject to any disclaimer, the term of this patent is extended or adjusted under 35 U.S.C. 154(b) by 0 days.

(21) Appl. No.: 15/045,303

(22) Filed: Feb. 17, 2016

(51) Int. Cl.
*H04R 23/00* (2006.01)
*H04R 1/40* (2006.01)
*H04R 29/00* (2006.01)

(52) U.S. Cl.
CPC ..... *H04R 23/008* (2013.01); *H04R 1/406* (2013.01); *H04R 29/00* (2013.01)

(58) Field of Classification Search
CPC ..... E21B 47/1025; E21B 47/06; G06F 17/30306; G06F 17/30595
USPC ..... 385/11, 12; 166/337, 250.1
See application file for complete search history.

(56) References Cited

U.S. PATENT DOCUMENTS 8,249,400 B2 * 8/2012 Kilic ..... G01H 9/004 385/11
9,103,968 B2 * 8/2015 Carralero ..... G01D 5/268
2004/0151417 A1 * 8/2004 Lagakos ..... G01P 15/093 385/12
2004/0213502 A1 * 10/2004 Gauthier, Jr. ..... F41G 3/142 385/12
2005/0123303 A1 * 6/2005 Guttman ..... B41J 2/46 398/142
2009/0202194 A1 * 8/2009 Bosselmann ..... G01K 11/3206 385/12
2011/0268384 A1 * 11/2011 Akkaya ..... G01H 9/004 385/12
2013/0092371 A1 * 4/2013 Hartog ..... E21B 47/06 166/250.01
2013/0293116 A1 * 11/2013 Carreras Molins H05B 33/0872 315/152
2014/0110124 A1 * 4/2014 Goldner ..... E21B 47/1025 166/337

(Continued)

OTHER PUBLICATIONS

Michael Mondanos, SILIXA monitoring the future with the next generation of sensors, Monico Workshop NTUA, 2011, pp. 1-19, Silixa Ltd.

(Continued)

*Primary Examiner* — Mohammad Islam

(57) ABSTRACT

A microphone array for detecting acoustic emissions generated by equipment. The array includes at least one grid having a plurality of sensors each including a compact arrangement of optical fiber having first and second optical fiber ends wherein the first optical fiber end of a first sensor is terminated. The array also includes an optoelectronic device coupled to a second optical fiber end of a second sensor, wherein the optoelectronic device generates laser light that is transmitted through the plurality of sensors in the grid and is reflected back to the optoelectronic device to enable detection of acoustic emissions.

20 Claims, 3 Drawing Sheets

(56) References Cited

U.S. PATENT DOCUMENTS

| | | | | |
|---|---|---|---|---|
| 2014/0314251 | A1 | 10/2014 | Rosca et al. | |
| 2016/0162519 | A1* | 6/2016 | Stowe | G06F 17/40 707/755 |

OTHER PUBLICATIONS

Tom Parker, Sergey Shatalin, Mahmoud Farhadiroushan, Distributed Acoustic Sensing—a new tool for seismic applications, Feb. 2014, pp. 1-9, vol. 32, first break.

Loudness Comparison Chart, California Department of Transportation.

* cited by examiner

OPTICAL FIBER BASED MICROPHONE ARRAY FOR DETECTING ACOUSTIC EMISSIONS GENERATED BY AN AREA OF INTEREST

FIELD OF THE INVENTION

This invention relates to detecting acoustic emissions in equipment, and more particularly, to a microphone array including a plurality of sensors each having a compact arrangement of optical fiber.

BACKGROUND OF THE INVENTION

Distributed sensor networks are frequently used for complex sensing applications including, for example, the monitoring of local events via acoustic sound detection over a large measurement space. This includes the detection of acoustic emission sources such as fluid leaks, mechanical impact, sliding contact, fluid cavitation, wear and friction of large gas turbines and others. Often the events of interest occur at an unknown time and location and can only be observed accurately with nearby sensors. For selected applications, a sensor network may be moved to a nearby sound detection location such as when conducting product sound emission characterization in a controlled test environment.

However, movement of the sensor network is not desirable or feasible for applications wherein large sensor networks are used to monitor sound emissions of equipment in the field, such as in oil exploration, oil field monitoring, submarine detection and other applications. For such applications, it is desirable to monitor an entire sensor network and adaptively focus on areas of interest e.g., if an event of interest occurs at an unpredictable location. Such sensor networks require a relatively large sensor density which results in a relatively large number of sensors. For example, more than 1000 sensors may be used in order to provide sufficient sensor density. However, the sensors used in such networks are expensive and complex. Further, it is important that the exact location of each sensor is known. Thus, it is difficult to deploy such networks in a time and cost effective way since the physical dimensions of each installation vary.

SUMMARY OF INVENTION

A microphone array is disclosed for detecting acoustic emissions generated by equipment. The array includes at least one grid having a plurality of sensors each including a compact arrangement of optical fiber having first and second optical fiber ends wherein the first optical fiber end of a first sensor is terminated. The array also includes an optoelectronic device coupled to a second optical fiber end of a second sensor, wherein the optoelectronic device generates laser light that is transmitted through the plurality of sensors in the grid and is reflected back to the optoelectronic device to enable detection of acoustic emissions.

Those skilled in the art may apply the respective features of the present invention jointly or severally in any combination or sub-combination.

BRIEF DESCRIPTION OF DRAWINGS

The teachings of the present disclosure can be readily understood by considering the following detailed description in conjunction with the accompanying drawings, in which.

To facilitate understanding, identical reference numerals have been used, where possible, to designate identical elements that are common to the figures.

DETAILED DESCRIPTION

Figure 1:
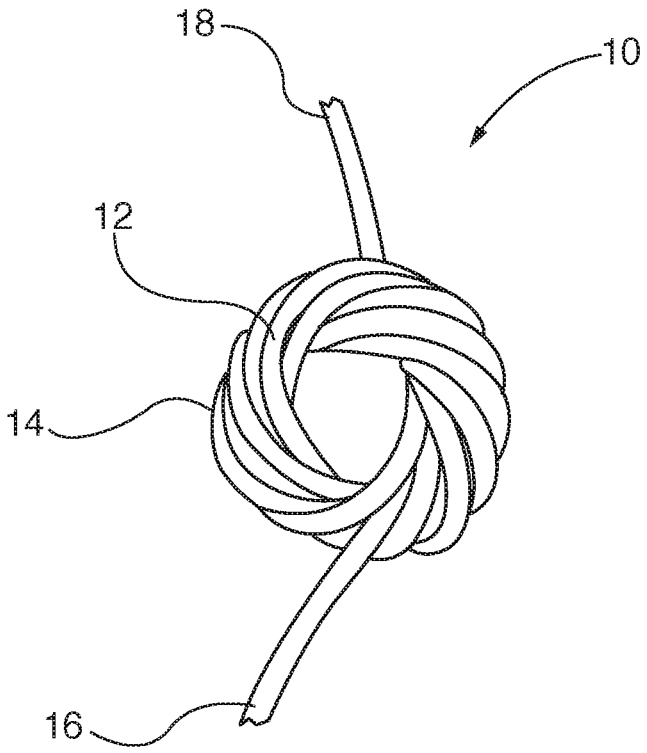
FIG. 1 is a view of a sensor for detecting acoustic emissions in accordance with the present invention.

Although various embodiments that incorporate the teachings of the present disclosure have been shown and described in detail herein, those skilled in the art can readily devise many other varied embodiments that still incorporate these teachings. The scope of the disclosure is not limited in its application to the exemplary embodiment details of construction and the arrangement of components set forth in the description or illustrated in the drawings. The disclosure encompasses other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass direct and indirect mountings, connections, supports, and couplings. Further, "connected" and "coupled" are not restricted to physical or mechanical connections or couplings.

Distributed sensing systems that utilize a length of optical fiber to measure acoustic sounds are known. Such systems are used to measure acoustic sounds generated due to traffic monitoring, border/perimeter control, production monitoring in oil and gas wells and other activities. Optical fiber sensitivity in such systems is typically on the order of approximately 60 dBA which is suitable for monitoring large industrial rotating machines such as gas turbines or other large noise generating installations. The spatial resolution of the measured sound, on the other hand, is approximately 1 to 4 meters(m) which is challenging for complex applications including noise generating rotary machines such as gas turbines or other large noise generating installations.

Referring to FIG. 1, a sensor 10 in accordance with the present invention is shown. The sensor 10 is fabricated from a length of optical fiber or fiber optic cable 12 that is configured into a dense or compact arrangement 14 having first 16 and second 18 cable ends. For example, the fiber optic cable 12 may be rolled, wound or coiled into a substantially ring, helix, spool or spiral shape, or combinations thereof to form a compact arrangement 14 having a substantially circular shape. It is understood that other shapes or cable arrangements may be utilized. In accordance with aspects of the present invention, the compact arrangement 14 exposes substantially all of the fiber optic cable length used to form the sensor 10 to the same localized sound or vibration generated by a nearby acoustic emission source. Thus, a larger optical fiber area is exposed to the nearby acoustic emission source due to the compact arrangement 14 which, in turn, amplifies the detected acoustic energy. In an embodiment, the cable length is approximately 1 m and may be wound as tightly as allowed by the bending limitations of the fiber optic cable 12 to form the sensor 10. For example, it has been found that a sensor 10 having a minimum bending diameter of approximately 2 centimeters (cm) (i.e. the minimum diameter to which the fiber optic cable 12 may be safely bent) located in an ambient environment with 340 m/s speed of sound capability is able to detect acoustic fields with frequencies of up to approximately 10 kHz. In accordance with aspects of the present invention, the sensor 10 serves as a microphone.

Figure 2:
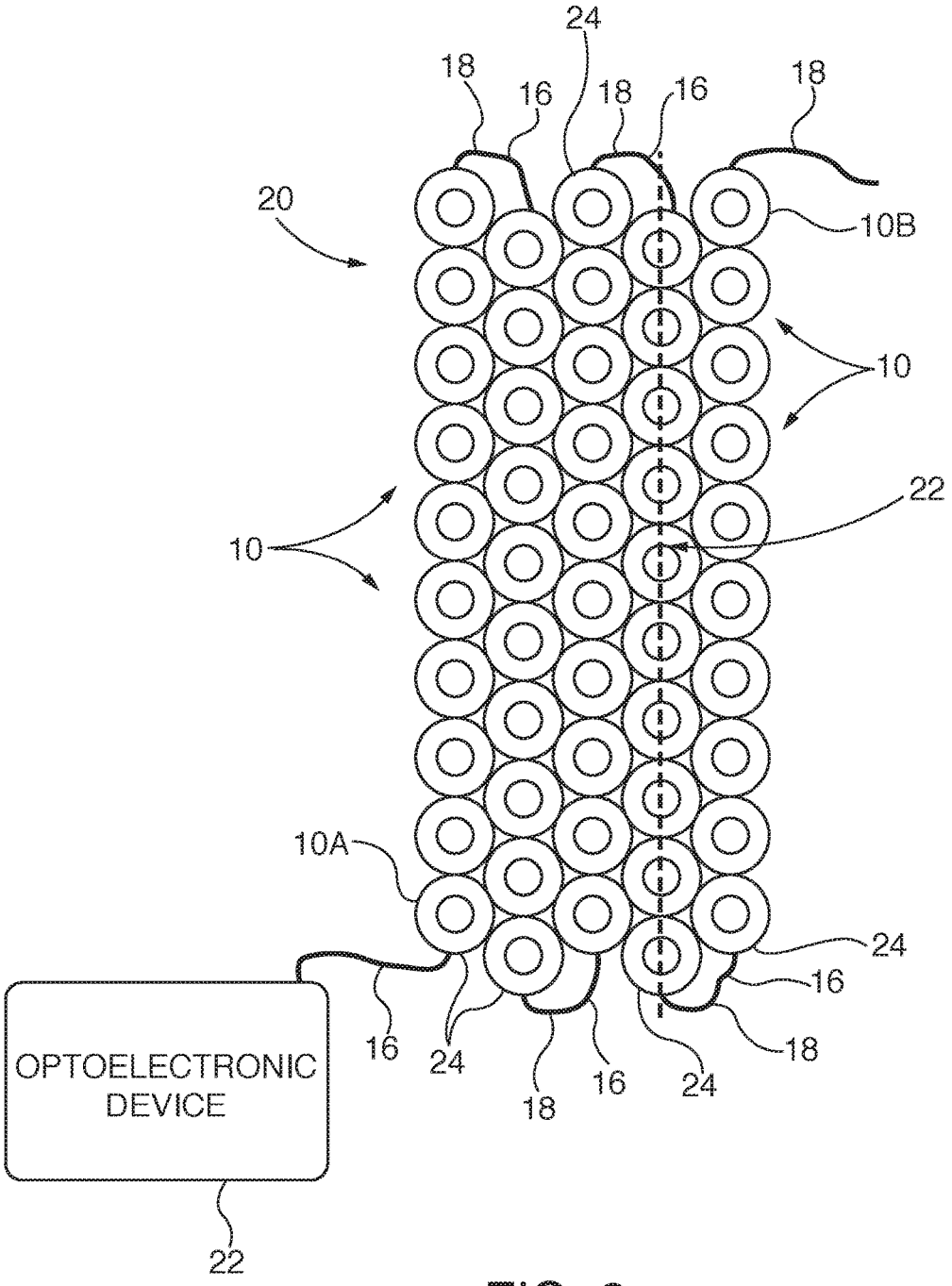
FIG. 2 is a view of a microphone array including a plurality of the sensors shown in FIG. 1.

In accordance with an aspect of the present invention, a plurality of sensors 10 or microphones may be formed and arranged in a grid pattern 20 as shown in FIG. 2 to form a microphone array. The sensors 10 includes a first sensor 10A having a first cable end 16 that is connected to a known optoelectronic device 22 such as the intelligent Distributed Acoustic Sensor (iDAS™) optoelectronic system available from Silixa Ltd, Elstree, Hertfordshire, UK. A second cable end 18 of first sensor 10A and each sensor 10 is connected to a first cable end 16 of an adjoining sensor 10 to form a series arrangement. The sensors 10 also include a last sensor 10B having a second cable end 18 that is closed off or terminated to form the microphone array. Alternatively, the grid 20 may be fabricated from a single length of optical fiber.

In an embodiment, the sensors 10 are equally spaced relative to each other. Further, the sensors 10 may be arranged in staggered columns 24 to form a substantially rectangular grid 20. This forms a flexible grid arrangement that can then be rolled up after manufacture and shipped as a roll to a work or installation site. The grid 20 may then be unrolled and cut to size as needed. For example, the grid 20 may be cut along a cut line 28 that extends through a column 24 of sensors 10 in order to meet the size requirements of an installation. In accordance with an aspect of the invention, cutting through a column 24 of sensors 10 does not affect other sensors 10 in the grid 20.

Figure 3:
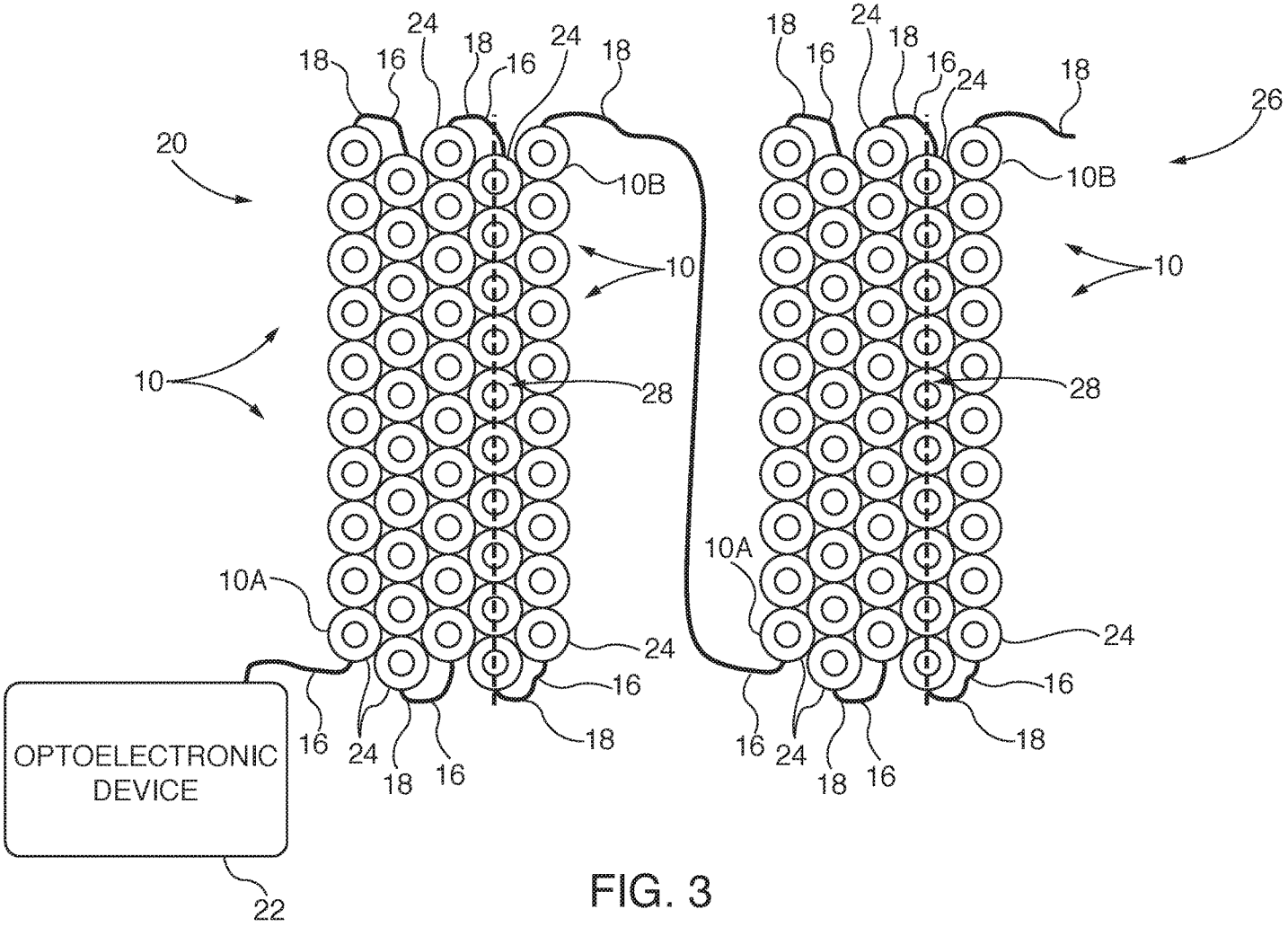
FIG. 3 is a view of a second microphone array connected to the microphone array shown in FIG. 2.

Further, the relative positioning between each sensor 10 remains substantially unchanged after installation so as to facilitate beamforming, e.g., the localization of sound sources for a known acoustic camera thereby enhancing spatial resolution. In an embodiment, a cloth material may be used to cover and protect the grid. Alternatively, at least one additional grid may be aligned with the grid 20 and then connected if, for example, a larger microphone array is desired. Referring to FIG. 3, a second grid 26 or microphone array is shown located adjacent a first grid 20. In this embodiment, the second cable end 18 of the last sensor 10B of the first grid 20 is connected to a first cable end 16 of a first sensor 10A of the second grid 26.

Known techniques may then be used to detect acoustic sound generated by a rotary machine such as a gas turbine or other large noise generating installation. In particular, laser light is sent into the first end 16 of the optical fiber and through at least one sensor 10 or grid 20 by the optoelectronic device 22. Acoustic sound is then detected by the optoelectronic device 22 based on an interferometric analysis of laser light reflected back via Rayleigh scattering. In an embodiment, multiple laser wavelengths can be used in parallel to allow for higher measurement data throughput.

The present invention provides a relatively large (e.g., greater than 1000 sensor) microphone array that utilizes conventional optical fiber and thus is low cost and robust and further, can be mass produced. The array may be used to monitor any complex industrial installation, especially noise generating rotary machines such as gas turbines. In addition, the array can be readily transported and installed at custom locations while also allowing accurate positioning of the sensors 10. This provides enhanced spatial resolution and results in substantially higher measurement accuracy. In addition, undesirable sparking and electrical interference and related problems that occur with conventional systems are avoided. Further, the structural strength of cable is increased.

The grid 20 of the present invention results in the formation of a relatively large number of sensors 10. For example, a 6 m×2 m grid 20 utilizing sensors 10 having an approximate 2 cm diameter provides approximately 30,000 sensors 10, each sampling at 20 kHz to monitor a full range up to 10 kHz. For standard 16 bit accuracy, the sensors 10 would generate a relatively large amount of data, i.e., approximately 1.2 GB/s of data, and would require substantial computational resources to process. In order to reduce the amount of data, the acoustic space may be sampled by different precomputed beamformers that only use a subset of sensors 10 for a particular focus location. This sensor subset may be selected based on the frequency and area of interest at each point in time. Further, not all sensors 10 add equal value for each beamformer. Thus, the data rate can be significantly reduced. In this regard, a mathematical optimization approach for sparse microphone selection is disclosed in US Patent Publication No. 2014/0314251 A1, published Oct. 23, 2014 and entitled BROADBAND SENSOR LOCATION SELECTION USING CONVEX OPTIMIZATION IN VERY LARGE SCALE ARRAYS, which is hereby incorporated by reference in its entirety. In some applications it may be possible to only connect a costly laser based data acquisition system at periodic time instances for e.g., lifetime assessment or troubleshooting. This further reduces the system deployment costs as only the minimal fiber and installation cost have to be considered.

While particular embodiments of the present disclosure have been illustrated and described, it would be obvious to those skilled in the art that various other changes and modifications can be made without departing from the spirit and scope of the disclosure. It is therefore intended to cover in the appended claims all such changes and modifications that are within the scope of this disclosure.

What is claimed is:

1. A microphone array for detecting acoustic emissions generated by equipment, comprising:

at least one grid including a plurality of sensors wherein each sensor includes an optical fiber that is arranged in a substantially circular configuration to form a compact arrangement for each sensor wherein each sensor includes first and second optical fiber ends wherein the first optical fiber end of a first sensor is terminated; and an optoelectronic device coupled to a second optical fiber end of a second sensor, wherein the optoelectronic device generates laser light that is transmitted through the plurality of sensors in the grid and is reflected back to the optoelectronic device to enable detection of acoustic emissions.

2. The array according to claim 1, wherein each compact arrangement is ring shaped.

3. The array according to claim 1, wherein the sensors are arranged in at least one column to form the grid.

4. The array according to claim 1, wherein the sensors are substantially equally spaced relative to each other.

5. The array according to claim 1, wherein the grid is cut along a column to a desired size.

6. The array according to claim 1, wherein a first optical fiber end of each sensor is coupled to a second optical fiber end of an adjoining sensor.

7. The array according to claim 1, wherein the compact arrangement includes approximately one meter of optical fiber.

8. A sensor device for detecting acoustic emissions generated by equipment, comprising:

at least one compact arrangement of optical fiber that is arranged in a substantially circular configuration, wherein the compact arrangement includes first and second optical fiber ends wherein the first optical fiber end is terminated; and an optoelectronic device coupled to the second optical fiber end, wherein the optoelectronic device generates laser light that is transmitted through the compact arrangement and is reflected back to the optoelectronic device to enable detection of acoustic emissions.

9. The sensor device according to claim 8, wherein the compact arrangement is ring shaped.

10. The sensor device according to claim 8, wherein the sensor device includes a plurality compact arrangements of optical fiber arranged in at least one column to form a grid.

11. The sensor device according to claim 10, wherein the compact arrangements are substantially equally spaced relative to each other.

12. The sensor device according to claim 10, wherein the grid is cut along a column to a desired size.

13. The sensor device according to claim 10, wherein a first optical fiber end of each compact arrangement is coupled to a second optical fiber end of an adjoining compact arrangement.

14. The sensor device according to claim 8, wherein the compact arrangement includes approximately one meter of optical fiber.

15. A method for detecting acoustic emissions generated by equipment, comprising:

providing at least one grid including a plurality of sensors wherein each sensor includes an optical fiber that is arranged in a substantially circular configuration to form a compact arrangement for each sensor wherein each sensor includes first and second optical fiber ends wherein the first optical fiber end of a first sensor is terminated; and providing an optoelectronic device coupled to a second optical fiber end of a second sensor, wherein the optoelectronic device generates laser light that is transmitted through the plurality of sensors in the grid and is reflected back to the optoelectronic device to enable detection of acoustic emissions.

16. The method according to claim 15, wherein each compact arrangement is ring shaped.

17. The method according to claim 15, wherein the sensors are arranged in at least one column to form the grid.

18. The method according to claim 15, wherein the sensors are substantially equally spaced relative to each other.

19. The method according to claim 15, wherein the grid is cut along a column to a desired size.

20. The method according to claim 15, wherein a first optical fiber end of each sensor is coupled to a second optical fiber end of an adjoining sensor.

* * * * *